US011199062B1

(12) United States Patent
Peterson et al.

(10) Patent No.: US 11,199,062 B1
(45) Date of Patent: Dec. 14, 2021

(54) SYSTEMS, METHODS, AND APPARATUSES FOR IDENTIFYING GROUNDWATER DURING ROCK DRILL CUTTING

(71) Applicant: Caterpillar Global Mining Equipment LLC, Denison, TX (US)

(72) Inventors: James Peterson, Denison, TX (US); Ryan Howell, Denver, CO (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 17/122,131

(22) Filed: Dec. 15, 2020

(51) Int. Cl.
*E21B 21/015* (2006.01)
*E21B 21/06* (2006.01)
*E21B 7/02* (2006.01)

(52) U.S. Cl.
CPC ..... *E21B 21/015* (2013.01); *E21B 21/066* (2013.01); *E21B 7/025* (2013.01)

(58) Field of Classification Search
CPC ..... E21B 21/01–019
See application file for complete search history.

(56) References Cited

U.S. PATENT DOCUMENTS

| | | | |
|---|---|---|---|
| 6,839,000 | B2 | 1/2005 | Das et al. |
| 7,193,414 | B2 | 3/2007 | Kruspe et al. |
| 8,152,410 | B2 | 4/2012 | Roth |
| 9,194,183 | B2 | 11/2015 | Stacy, II et al. |
| 10,024,114 | B2 | 7/2018 | Vandapel et al. |
| 10,151,199 | B2 | 12/2018 | Kuiper |
| 10,222,191 | B2 | 3/2019 | Handel |
| 2017/0044894 | A1* | 2/2017 | Surowinski ..... E21B 47/00 |

FOREIGN PATENT DOCUMENTS

| | | | |
|---|---|---|---|
| EP | 2 321 490 | B1 | 1/2019 |
| JP | 11-247576 | A | 9/1999 |
| WO | 2010/029216 | A1 | 3/2010 |

* cited by examiner

*Primary Examiner* — Kristyn A Hall
(74) *Attorney, Agent, or Firm* — Xsensus LLC

(57) ABSTRACT

A system, method, and apparatus can identify groundwater as a drilling machine drills a drill hole. Presence or not of groundwater can be continuously monitored as the drilling machine drills the drill hole using one or more groundwater or moisture sensors to detect moisture or water content of cuttings from the drill hole. Such data from the sensor(s) can be processed to determine the presence or not of groundwater and associate the determination with the corresponding location within the drill hole. A mapping or logging of the drill hole can be generated with the location or locations where the presence of groundwater is identified.

20 Claims, 3 Drawing Sheets

SYSTEMS, METHODS, AND APPARATUSES FOR IDENTIFYING GROUNDWATER DURING ROCK DRILL CUTTING

TECHNICAL FIELD

The present disclosure relates to identification of groundwater, and more particularly to systems, methods, and apparatuses for identifying groundwater during rock drill cutting.

BACKGROUND

Drilling holes in rock frequently intersects with groundwater while drilling. However, in quarry and mining applications if the operator is unable to detect the water location the use of expensive explosive products may be required. This can lead to higher cost for the blasting process and/or result in poor detonation of the explosives. In the context of in-ground stabilization drilling, if the operator does not know the existence or location of water, the hole column may be grouted more than necessary. This can lead to higher costs and result in unnecessarily hydrofracking rock.

European Patent Document EP 232149 ("the EP '149 patent document") describes a method for handling drill cuttings, where drill cuttings are directed based on water content either to a dust separator of a dust collection system or away from the dust collection system before the dust separator. According to the EP '149 patent document, directing the drill cuttings away from the dust collection system prevents problems caused to the dust collection system by excessively aqueous drill cuttings. The EP '149 patent document also describes that water content of drill cuttings can be detected automatically using a water content sensor, such as a moisture detector. However, the EP '149 patent document is not understood to identify groundwater location in the drill hole based on the detected water content of the drill cuttings.

SUMMARY

According to an aspect a non-transitory computer-readable storage medium having stored thereon instructions that, when executed by one or more processors, cause the one or more processors to perform a method is disclosed or provided. The method can comprise continuously determining presence or not of groundwater in a blasthole based on signals from one or more moisture sensors regarding moisture content of rock cuttings as a drilling machine drills the blasthole. The method can also comprise continuously mapping the blasthole for groundwater based on said continuously determining presence or not of groundwater as the drilling machine drills the blasthole, the mapping including location in the blasthole where the presence of groundwater is identified. The continuously determining presence or not of groundwater can include determining when a water content value of the rock cuttings increases by a predetermined amount.

In another aspect, a method of determining groundwater location at a worksite via a set of one or more drill holes at the worksite is disclosed or implemented. The method can comprise receiving, in real time, using an electronic processor, signaling from a moisture sensor regarding moisture content of cuttings at a collar of one of the one or more drill holes as the cuttings exit the drill hole as a drilling machine drills the drill hole; determining, in real time, using the electronic processor, whether groundwater exists in the drill hole based on the signaling from the moisture sensor regarding moisture content of the cuttings, as the drilling machine drills the drill hole; and logging, in real time, using the electronic processor, depth in the drill hole at which each groundwater determination occurs, as the drilling machine drills the drill hole. The determining whether groundwater exists can include determining when a water content value of the cuttings has increased by a predetermined amount relative to an immediately previous water content value of the cuttings.

And in another aspect a rock drill cutting system for determining groundwater elevation is disclosed or provided. The rock drill cutting system can comprise a groundwater detection sensor configured to measure, in real time, water content of rock cuttings exiting a collar of a blasthole as the rock cuttings are flushed from the blasthole using a stream of compressed air emanating from a rotary drill bit as the rotary drill bit performs a rock drill cutting operation to progressively drill the blasthole; and circuitry of a drilling machine operatively coupled to the groundwater detection sensor. The circuitry can be configured to continuously analyze, in real time, water content data from the groundwater detection sensor as the rotary drill bit progresses in depth of the blasthole, to determine existence of groundwater at predetermined depth intervals of the blasthole, and generate a map of the blasthole as the rotary drill bit progresses in depth of the blasthole to completion of the blasthole based on the continuous analysis of the water content data from the groundwater detection sensor, the map representing which depth or depths within the blasthole are identified to have groundwater and which are identified not to have groundwater. The continuous analysis to determine existence of groundwater can include determining when the water content data indicates that a water content value of the rock cuttings has increased by a predetermined amount relative to an immediately previous water content value of the rock cuttings.

Other features and aspects of this disclosure will be apparent from the following description and the accompanying drawings.

DETAILED DESCRIPTION

The present disclosure relates to identification of groundwater, and more particularly to systems, methods, and apparatuses for identifying groundwater during rock drill cutting.

Figure 1:
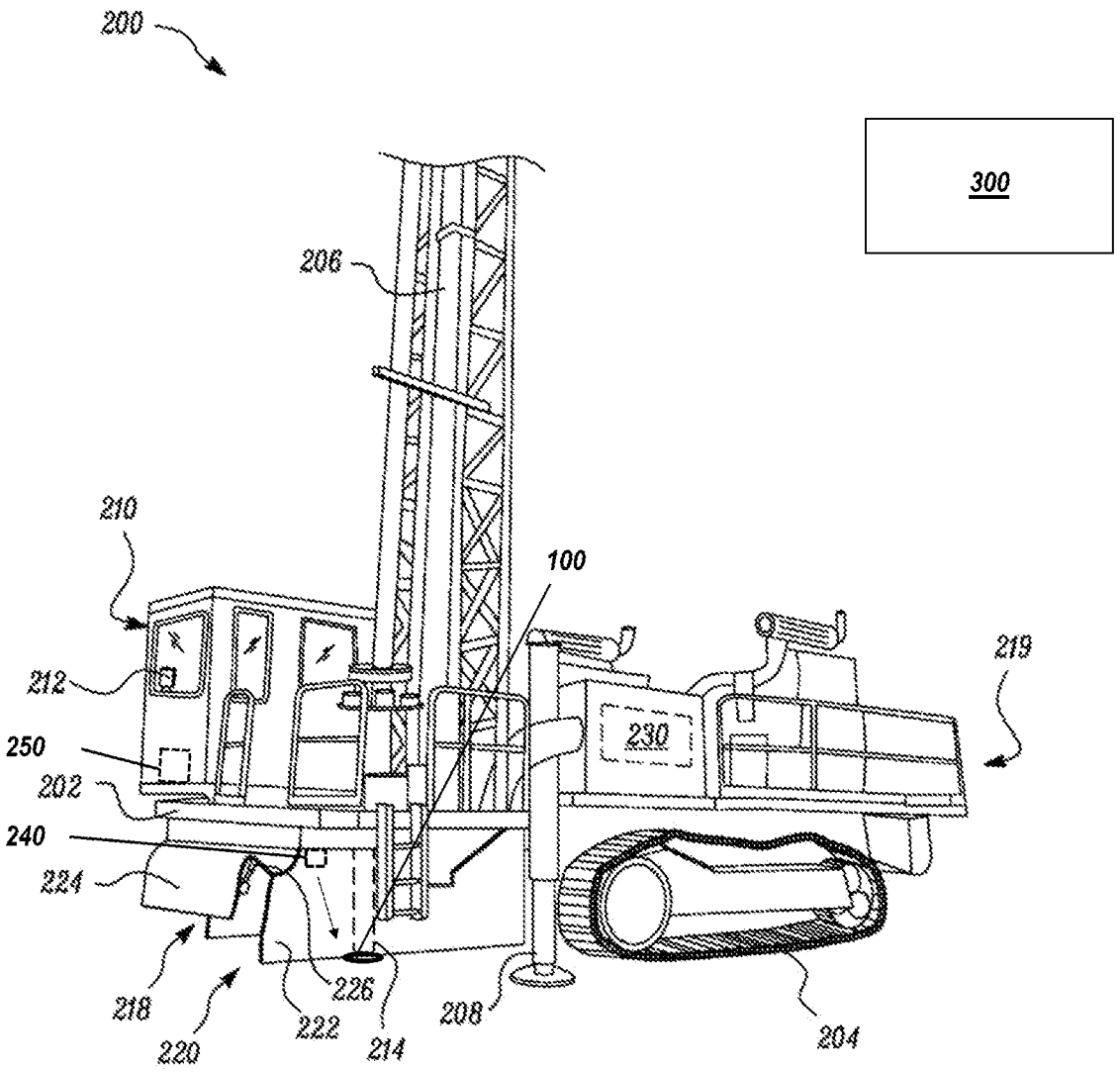
FIG. 1 shows a drilling system according to one or more embodiments of the disclosed subject matter.

FIG. 1 illustrates a drilling machine 200 in accordance with one or more embodiments of the present disclosure. The drilling machine 200 can be configured to operate on a worksite such as a construction site or a mining site. The drilling machine 200 can be manually, autonomously, or semi-autonomously operated. Moreover, the drilling machine 200 can be locally controlled at the worksite via operator input (manual and/or wireless) and/or remotely controlled from a location remote from the worksite, such as a back office system 300. The communication between the drilling machine 200 and the back office system 300 may be via wired and/or wireless systems.

The drilling machine 200 can include a frame 202 supported on a transport mechanism, such as crawler tracks 204 in a rear portion 219 of the drilling machine 200, as illustrated in FIG. 1, for instance. The drilling machine 200 may further include a mast 206 mounted on the frame 202 and supported about a pivot. The drilling machine 200 may also include jacks 208 that may be extended to support (including level) the drilling machine 200 during a drilling operation. The drilling machine 200 may further include a cabin 210. An operator control interface 212 may be provided in the cabin 210 to control at least some operations of the drilling machine 200. The operator control interface 212 may include a display device to display to an operator visual data of operating conditions of the drilling machine 200. Discussed in more detail below, the visual data may include information regarding identification of groundwater during the drilling operation of the drilling machine 200. Also discussed in more detail below, such groundwater identification information may include a location (e.g., depth) within a drill hole 100 at which the groundwater is identified.

The drilling machine 200 can also include a work tool 214, supported by the mast 206, for performing the drilling operation. The work tool 214 may include a rotary drill bit (e.g., a rotary tricone drill bit). The work tool 214 may be rotated via one or more electric motors of the drilling machine 200 or via a hydraulic system of the drilling machine 200. Thus, the drilling machine 200 may be characterized as an electric drilling machine (full or partial electric) or a hydraulic drilling machine (e.g., a hydraulic rock drill).

According to one or more embodiments, the drilling machine 200 may include a dust containment system 218 provided below the frame 202. The dust containment system 218 can define an enclosure 220 for covering the work tool 214 between one or more walls 222 and a dust curtain 224. In an embodiment, a plurality of dust curtains 224 may define the enclosure for covering the work tool 214. The drilling operation can be performed with the work tool 214 within the enclosure 220 of the dust containment system 218.

The dust containment system 218 may include one or more actuators 226 attached to the frame 202 of the drilling machine 200. The one or more actuators 226 may be connected to the dust curtain 224. Based on the movement of the actuators 226, the height of the dust curtain 224 with respect to a ground surface of the worksite can be adjusted. In accordance with an embodiment, the actuators 226 may be hydraulically operated. However, the actuators 226 may alternatively be operated pneumatically or mechanically, based on the particular configuration of drilling machine 200.

The drilling machine 200 may also include a dust suppression system 230. The dust suppression system 230 can be configured to control the amount of dust generated and released during a drilling operation performed by the drilling machine 200. According to one or more embodiments, the dust suppression system 230 can be configured to automatically detect and predict dust levels generated by the drilling operation of the drilling machine 200 at the worksite.

The dust containment system 218 and/or the dust suppression system 230 may be referred to as a dust management system 218/230. Discussed in more detail below, either or both parts of the dust management system 218/230 can be controlled based on identification of groundwater in the drill hole 100 during the drilling operation of the drilling machine 200. For instance, the dust suppression system 230 may be turned off in response to identification of groundwater in the drill hole 100 during the drilling operation of the drilling machine 200. To be clear, drilling machines, such as drilling machine 200, according to one or more embodiments of the disclosed subject matter may not include the dust containment system 218 or the like and/or may not include the dust suppression system 230 or the like. That is, according to one or more embodiments, the drilling machine without the dust containment system 218 and/or the dust suppression system 230 may detect and determine groundwater location within the drill hole 100 without regard to functionality of the dust containment system 218 and/or the dust suppression system 230.

A controller 250 of the drilling machine 200, which may represent one or more controllers, can be operatively provided to control various components of the drilling machine 200. For instance, the controller 250 can control the drilling operation, for instance, the rotation rate of the work tool 214, the rate or penetration of the work tool 214, retraction of the work tool 214, etc. The controller 250 can also control operation of the jacks 208, the crawler tracks 204, the dust containment system 218, and/or the dust suppression system 230. Optionally, the controller 250 can be operatively coupled to the operator control interface 212. Thus, some or all of such control can be via operator input to the operator control interface 212. Control information pertaining to the operation of the drilling machine 200 can also be sent to the operator control interface 212 via the controller 250.

One or more water or moisture sensors 240 can be provided. Each sensor 240 can be an optical or laser sensor aimed at and/or adjacent a collar of the drill hole 100 (as diagrammatically shown by the dashed arrow in FIG. 1). According to one or more embodiments, the sensor 240 can be located below the frame 202 of the drilling machine 200. In any case, the sensor 240 can be provided to measure or detect water content at the collar of the drill hole 100 as the drilling machine 200 performs a drilling operation. More specifically, the sensor 240 can measure water content of cuttings (e.g., rock cuttings or chips) exiting the drill hole 100 as the cuttings are flushed from the drill hole 100. The cuttings may be expelled from the drill hole 100 using air (e.g., a stream of compressed air) output at a bottom end of the work tool 214 (e.g., a bottom face of a rotary drill bit) as the work tool 214 progressively drills the drill hole 100. According to one or more embodiments, the sensor 240 may measure characteristics associated with a refractory of light breakdown from the cuttings.

Different refractive ranges may be associated with groundwater coating the cuttings versus either no water coating the cuttings or a relatively small amount of water coating the cuttings. The relatively small amount of water may be introduced into the drill hole 100 from a water injection system 245 during the drilling operation of the drilling machine 200. Thus, the sensor 240 may be sensitive enough to sense changes in water content to detect that the change is representative of the work tool 214 intersecting groundwater as the drilling machine 200 drills the drill hole 100, even if water is being introduced or has been introduced into the drill hole 100 from the water injection system 245. The sensor 240 can also detect, or be used to determine, an amount (e.g., volume) of groundwater in the drill hole 100 associated with the cuttings exiting the drill hole 100. Thus, the sensor 240 can measure changes in moisture or water content of the cuttings exiting the drill hole 100 to identify existence of groundwater at particular locations (e.g., depths) in the drill hole 100. Such measurements can also identify locations (e.g., depths) in the drill hole 100 where groundwater is not identified, including transitions to and from groundwater locations relative to dry locations within the drill hole 100.

Generally, the drilling machine 200 can be configured to drill the drill hole 100 in earthen material below the drilling machine 200 using the work tool 214 and corresponding components (e.g., drill string, etc.). The drill hole 100 may be referred to as a blasthole 100 or a probe hole 100 and can be vertical or substantially vertical. An initial opening of the drill hole 100 may be referred to as a collar. After the drill hole 100 has been drilled and the drilling machine 200 moved from over the drill hole (and optionally after all drill holes or a subset of drill holes at the worksite have been completed), explosives can be placed at predetermined locations within one or more (e.g., all) of the drill holes 100. The path of the cuttings from the rock-work tool 214 interface to exiting the drill hole 100 can be substantially instantaneous, at least from the perspective of an operator of the drilling machine 200. For instance, the cuttings may exit the drill hole 100 at or about at a velocity of 5000 ft/min. Hence, the accuracy of measurements regarding the locations of the cuttings from within the drill hole 100 as described herein can be according to millimeter accuracy, for instance, within at or about 1 mm to at or about 2 mm.

Figure 2:
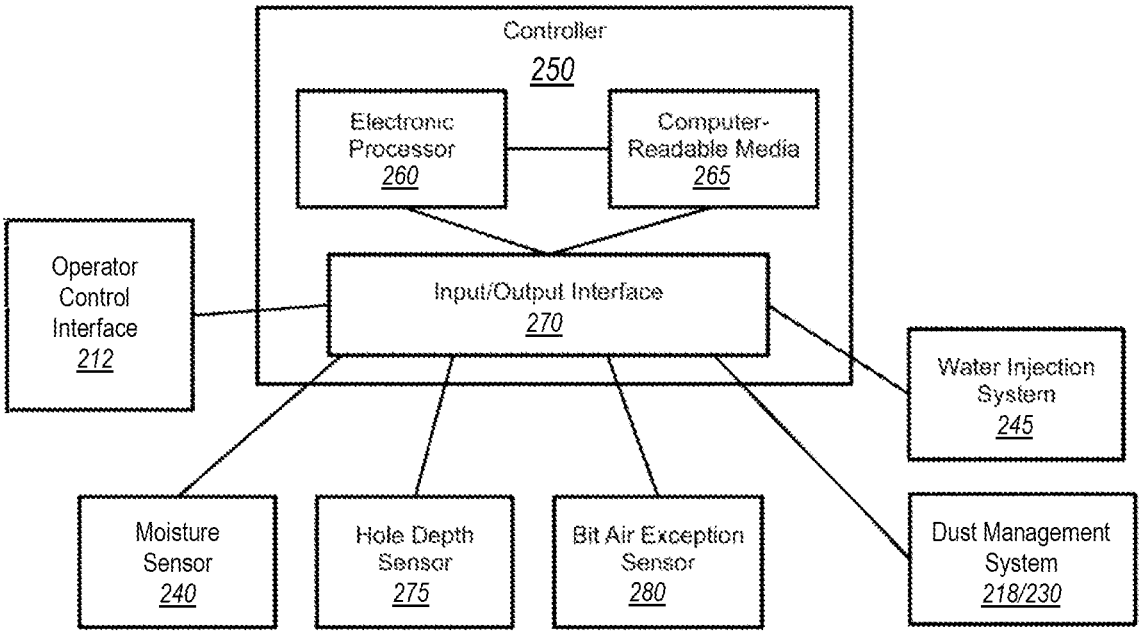
FIG. 2 is a block diagram of a control system according to one or more embodiments of the disclosed subject matter.

FIG. 2 schematically illustrates the controller 250 associated with the drilling machine 200 according to one or more embodiments of the present disclosure. It should be understood that the controller 250 can be included in the drilling machine 200 (e.g., mounted on a component of the drilling machine 200), such as shown in FIG. 1. Additionally or alternatively, the controller 250, or portion thereof, may be a separate component positioned remote from the drilling machine 200 (e.g., as part of a remote control device or station for the drilling machine 200, such as the back office system 300).

The controller 250 can include an electronic processor 260, a non-transitory computer-readable media 265, and an input/output interface 270. The electronic processor 260, the computer-readable media 265, and the input/output interface 270 can be connected by one or more control and/or data buses that allow the components to communicate. It should be understood that the functionality of the controller 250 can be combined with one or more other controllers to perform additional functionality. Additionally or alternatively, the functionality of the controller 250 can be distributed among more than one controller.

The computer-readable media 265 can store program instructions and data. The electronic processor 260 can be configured to retrieve instructions from the computer-readable media 265 and execute, among other things, the instructions to perform the control processes and methods described herein. The input/output interface 270 can transmit data from the controller 250 to systems, networks, and devices located remotely or onboard the drilling machine 200 (e.g., over one or more wired and/or wireless connections). The input/output interface 270 can also receive data from systems, networks, and devices located remotely or onboard the drilling machine 200 (e.g., over one or more wired and/or wireless connections). The input/output interface 270 can provide received data to the electronic processor 260 and, in some embodiments, can also store received data to the computer-readable media 265.

As illustrated in FIG. 2, the controller 250 can communicate with the operator control interface 212. As noted above, the operator control interface 212 can allow the operator to control various operations of the drilling machine 200, including some or all aspects of the drilling operation of the drilling machine 200. As examples, the operator control interface 212 can include one or more operator-controlled input devices, such as graphical user interface(s), joysticks, levers, foot pedals, and other actuators. The operator control interface 212 can also include a display device (which may provide the graphical user interface(s)). The display device may show various operating conditions of or associated with the drilling machine 200.

Generally, the operator control interface 212 can be configured to control the water injection system 245, the dust containment system 218, and/or the dust suppression system 230, at least in some respects. For example, the operator control interface 212 can allow an operator to enter desired settings for dust suppression, such as water flow rate, water flow cutoff depth, suction cutoff depth, particulate limit (e.g., size and/or amount), etc. However, the controller 250 may automatically control the water injection system 245, the dust containment system 218, and/or the dust suppression system 230, as discussed in more detail below, based on detection of groundwater in the drill hole 100. The operator control interface 212 can also output (e.g., display) information including a measured water tank level, a measured water flow rate, a water flow rate set point, a dust collector suction output, a dust collector suction set point, a measured particulate level, a particulate level set point, etc. pertaining to the dust management system 218/230 and/or the water injection system 245.

The controller 250 can also communicate with a hole depth sensor 275. Generally, the hole depth sensor 275 can measure depth of the drill hole 100 as the drill hole 100 is being drilled. As examples, such hole depth sensor 275 can sense position of the work tool 214 and/or a motor (e.g., electric motor) driving the work tool 214 to determine depth of the work tool 214 and hence the drill hole 100 as the drill hole 100 is drilled. The controller 250 can use depth data from the hole depth sensor 275 to associate depth of the drill hole 100 with location of identified groundwater.

A bit air exception sensor 280 may be provided to indicate a blockage in the drill hole 100. Remedial actions may need to be taken (e.g., retract the work tool 214) to clear the blockage. Such action can be performed manually via the operator control interface 212 or automatically using the controller 250, for instance.

The controller 250 can receive signals from the sensor 240. The signals can be received in real time and can be representative of moisture or water content of cuttings exiting the drill hole 100 as the work tool 214 of the drilling machine 200 progressively drills the drill hole 100. Such drilling operation of the drilling machine 200 may be referred to as a rock cutting operation, since the earthen material being drilled by the drilling machine 200 can be formed at least partially of rock.

The controller 250 can analyze the signals from the sensor(s) 240 in real time as the work tool 214 drills the drill hole 100. This can include analysis of water content data associated with the signals as the work tool 214 progresses in depth to identify that the work tool 214 has reached a water-bearing seam of earthen material (e.g., rock). Such identification can be referred to as determining existence of groundwater in the drill hole 100. According to one or more embodiments, the analysis can be performed continuously according to predetermined depth intervals as the work tool 214 progresses in the drill hole 100. For instance, the predetermined depth intervals may on a millimeter basis, for instance, at or about 1 mm to at or about 2 mm.

The controller 250 may determine existence of groundwater when the water content data associated with the signals from the sensor(s) 240 indicates that a water content value of the cuttings increases by a predetermined amount relative to an immediately previous water content value of the cuttings exiting the drill hole 100. The predetermined amount may be according to a percentage increase. Thus, the difference in moisture content can identify where the drill hole 100 intersects groundwater of a water-bearing seam. More than one intersection can be identified in each drill hole 100. The drill hole 100, therefore, may intersect multiple water-bearing seams in some cases. Distinct locations of identified groundwater within one drill hole 100 may be referred to herein as instances of existence or presence of groundwater within the drill hole 100.

According to one or more embodiments, the immediately previous water content value can be a non-zero value due to water introduced into the drill hole 100 from a source other than the water-bearing seam, such as water provided to the drill hole 100 by the water injection system 245. Such immediately previous water content value may be a constant value in that water from the water injection system 245 can be provided at a constant rate. Alternatively, the immediately previous water content value can be zero or substantially zero, meaning that the immediately previous cuttings correspond to no water from the water injection system 245 being provided and lack of groundwater at the immediately previous location within the drill hole 100.

The analysis by the controller 250 may also determine an amount of water volume associated with the location in the drill hole 100 at which groundwater is determined to exist. The determined amount of water volume may be determined based on the amount of increase in the water content value discussed above. Such water volume may represent or may be processed by the controller 250 to determine an amount of water volume added or estimated to be added to the drill hole 100 by the portion of the water-bearing earthen system. In the case of multiple distinct locations of groundwater for one drill hole 100, i.e., multiple water-bearing seams, the controller 250 record how much water volume each groundwater location individually provides to the drill hole 100. Alternatively, the controller 250 may keep a running total of the total amount of added water or alternatively, determine the total amount of added water upon completion of the drill hole 100.

Existence of groundwater within the drill hole 100 can be associated with a corresponding location or locations within the drill hole 100. The controller 250 can perform such association in real time as the drilling machine 200 drills the drill hole 100. Location (e.g., depth) data from the hole depth sensor 275 can be used to identify position of the bottom of the work tool 214 in the drill hole 100 and hence from the location in the drill hole 100 from where the cuttings originated.

The association of groundwater identification with location in the drill hole 100 may be characterized as mapping or logging the drill hole 100 in terms of groundwater locations within the drill hole 100. Such mapping or logging may also identify locations where groundwater is not identified to be present when drilling the drill hole 100. Thus, the association can represent depth or depths within the drill hole 100 at which the work tool 214 intersected groundwater. In this regard, the mapping or logging can also include location of transition to and transition from the groundwater seam. For instance, the mapping or logging can include one or more intersections in the drill hole 100 between dry rock and wet rock corresponding to existence of groundwater. The logging or mapping can also identify an amount of water volume associated with each existence of groundwater. Such amount of water volume may be representative of how much water the water-bearing seam provides to the drill hole 100.

According to one or more embodiments, the controller 250 can reduce an amount of water introduced into the drill hole 100 by the water injection system 245 when the existence of groundwater is determined from the analysis of the water content of the cuttings. For example, the controller 250 can reduce the amount of water to zero or a value less than a value prior when groundwater is identified during the drilling operation. Optionally, the controller 250 can reduce the amount of water supplied to the drill hole 100 by the water injection system 245 each time groundwater is identified when drilling the drill hole 100. Thus, in a case where the work tool 214 intersects multiple water-bearing seams separated by a non-water-bearing seam when drilling the drill hole 100, the water from the water injection system 245 may be reduced upon the work tool 214 reaching the first water-bearing seam, increased after the work tool 214 exits the first water-bearing seam, and reduced again upon the work tool 214 reaching the second water-bearing seam. The intervening location in the drill hole 100 associated with no groundwater may be referred to as a third depth within the drill hole 100 separating first and second depths associated with existence of groundwater within the drill hole 100. The reduction of water supplied from the water injection system 245 can be maintained until an identified transition from the groundwater location to the non-groundwater location in the drill hole 100 or a predetermined time after the transition.

Optionally, the controller 250 may control some or all of the dust management system 218/230 when the existence of groundwater is identified in the drill hole 100. For instance, the controller 250 may turn off the dust suppression system 230 or lower the suction speed thereof responsive to a determination of existence of groundwater in the drill hole 100. Such control of the dust management system 218/230 can be maintained until an identified transition from the groundwater location to a non-groundwater location in the drill hole 100 or a predetermined time after the transition.

Information regarding the groundwater determination may be provided to the operator via the operator control interface 212, for instance, on a display device thereof. Such groundwater determination information can be provided in real time to the operator control interface 212, including responsive to the determination of groundwater existence in the drill hole 100. Alternatively, such groundwater determination information can be continuously output by the operator control interface 212 and can include a mapping or logging of the groundwater determinations versus location in the drill hole 100 as the drilling machine 200 drills the drill hole 100. Output of such groundwater determination information may be used by the operator to control the drilling machine 200 or portions thereof, such as the dust management system 218/230 and/or the water injection system 245. Alternatively, as noted above, such systems can be automatically controlled by the controller 250 based on the determination of existence of groundwater within the drill hole 100.

Groundwater location information can be offloaded from the drilling machine 200, for instance, to the back office system 300. Such offloading can be via a wired and/or wireless network and can be performed after (e.g., upon) completion of the drilling operation to drill the drill hole 100. According to one or more embodiments, the groundwater location information can be offloaded as a mapping or a log, such as described above. Optionally, the groundwater location information can be formatted in a batch file and offloaded.

INDUSTRIAL APPLICABILITY

As noted above, the present disclosure relates to identification of groundwater, and more particularly to systems, methods, and apparatuses for identifying groundwater during rock drill cutting.

Generally, systems, methods, and apparatuses can identify groundwater as a drilling machine drills a drill hole, such as drilling machine 200 drilling drill hole 100. Presence (or not) of groundwater can be continuously monitored as the drilling machine 200 drills the drill hole 100 using one or more groundwater or moisture sensors 240 to detect moisture or water content of cuttings from the drill hole 100. Such data from the sensor(s) 240 can be processed, for instance, by a controller such as controller 250, to determine the presence (or not) of groundwater within the drill hole 100, as the drilling machine 200 drills the drill hole 100.

Location of the end of the work tool 214, as sensed determined position signaling from the hole depth sensor 275, for instance, can be used to identify a location within the drill hole 100 from which the cuttings associated with the determined groundwater came and hence location in the drill hole 100 where the work tool 214 met groundwater. A mapping or logging of the drill hole 100 can be generated, for instance, using the controller 250, with the location or locations where the presence of groundwater is identified. After completion of drilling the drill hole 100, the completed mapping or logging of the drill hole 100 can be offloaded from the drilling machine 200, for instance, to a back office system such as back office system 300. The mapping or logging information may be offloaded in a batch file.

Figure 3:
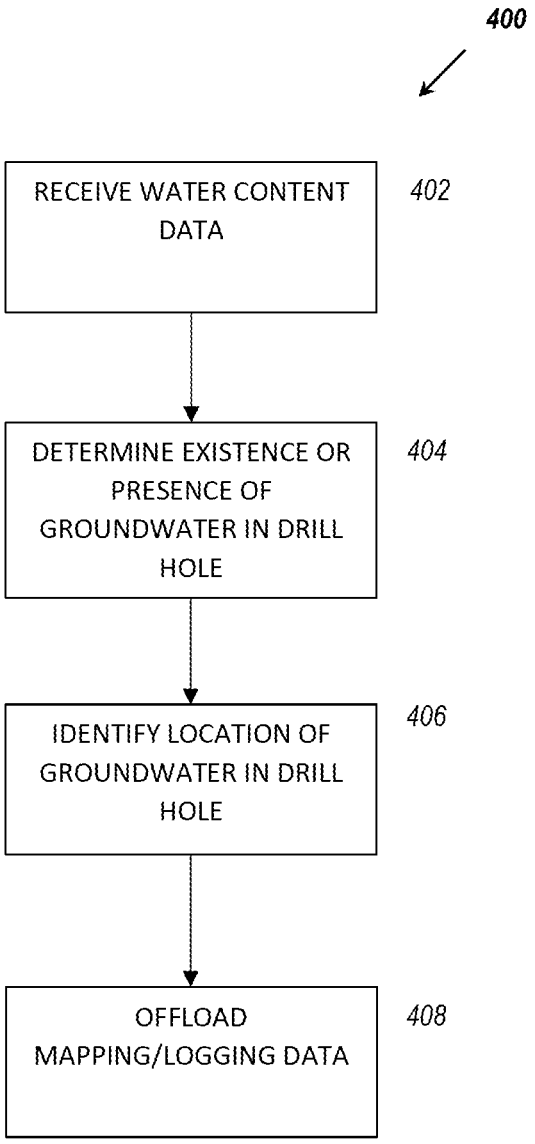
FIG. 3 is a basic flow chart of a method according to one or more embodiments of the disclosed subject matter.

FIG. 3 shows a block diagram of a method 400 according to one or more embodiments off the disclosed subject matter. Some or all of the method 400 can be performed using a non-transitory computer-readable storage medium having stored thereon instructions that, when executed by one or more processors (e.g., electronic processor 260 of the controller 250), cause the one or more processors to perform the method 400.

The method 400, at 402, can receive water or moisture content data from one or more water or moisture sensors, such as sensor 240. Such data can be received in real time, for instance, by the controller 250. The data can be representative of water or moisture content of cuttings at a collar of the drill hole 100 as the cuttings are expelled from the drill hole 100 while the drilling machine 200 progressively drills the drill hole 100.

At 404, the method 400 can process the water content data to determine existence or not of groundwater within the drill hole 100 corresponding to a location within the drill hole 100 from where the cuttings came. Such processing can be performed by the controller 250 in real time. The determination of whether groundwater exists or not can include determining when a water content value of the cuttings has increased by a predetermined amount, for instance, relative to an immediately previous water content value of the cuttings. The increase in water content can also be used to determine an amount of water (e.g., volume) associated with the determined groundwater in the drill hole 100. The determined amount of water can represent the amount of water supplied to the drill hole 100 by the corresponding water-bearing seam.

At 406, the method 400 can identify location of the identified groundwater within the drill hole 100. Such processing can be performed by the controller 250 in real time. Operation 406 can also involve identify locations in the drill hole 100 without groundwater. Such identification may be referred to as association of the groundwater with location within the drill hole 100. According to one or more embodiments, the association can be by way of logging or mapping the existence of groundwater or not relative to location within the drill hole 100 in real time as the drilling machine 200 drills the drill hole 100. The mapping or logging can be stored in memory of the controller 250. Optionally, such location association can include association of a water amount (e.g., water volume) associated with location of the identified groundwater within the drill hole 100.

At operation 408 the mapping or logging information can be offloaded from the drilling machine 200. The mapping or logging information can be offloaded after (e.g., upon) completion of the drilling of the drill hole 100. According to one or more embodiments, the offloading can be from the drilling machine 200 to the back office system 300.

The operations 402-408 can be performed for one or more additional drill holes 100. Groundwater location data pertaining to a set drill holes 100 at the worksite can be mapped, for instance, by the back office system 300, to map the terrain of the worksite and corresponding groundwater or moisture for the terrain. Such mapping can be used for the management and placement of blast charges in the drill holes 100. According to one or more embodiments, such mapping of groundwater for the set of drill holes 100 can include interpolation of groundwater location estimates between the drill holes 100.

As used herein, the term "circuitry" can refer to any or all of the following: (a) hardware-only circuit implementations (such as implementations in only analog and/or digital circuitry); (b) to combinations of circuits and software (and/or firmware), such as (as applicable): (i) a combination of processor(s) or (ii) portions of processor(s)/software (including digital signal processor(s)), software and memory(ies) that work together to cause an apparatus, such as a mobile phone or server, to perform various functions); and (c) to circuits, such as a microprocessor(s) or a portion of a microprocessor(s), that require software or firmware for operation, even if the software or firmware is not physically present.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A rock drill cutting system for determining groundwater elevation comprising:

a groundwater detection sensor configured to measure, in real time, water content of rock cuttings exiting a collar of a blasthole as the rock cuttings are flushed from the blasthole using a stream of compressed air emanating from a rotary drill bit as the rotary drill bit performs a rock drill cutting operation to progressively drill the blasthole; and circuitry of a drilling machine operatively coupled to the groundwater detection sensor and configured to continuously analyze, in real time, water content data from the groundwater detection sensor as the rotary drill bit progresses in depth of the blasthole, to determine existence of groundwater at predetermined depth intervals of the blasthole, and generate a map of the blasthole as the rotary drill bit progresses in depth of the blasthole to completion of the blasthole based on the continuous analysis of the water content data from the groundwater detection sensor, the map representing which depth or depths within the blasthole are identified to have groundwater and which are identified not to have groundwater, wherein the continuous analysis to determine existence of groundwater includes determining when the water content data indicates that a water content value of the rock cuttings has increased by a predetermined amount relative to an immediately previous water content value of the rock cuttings.

2. The rock drill cutting system according to claim 1, wherein the immediately previous water content value is a non-zero value due to water introduced into the blasthole from a water injection system of the drilling machine.

3. The rock drill cutting system according to claim 2, wherein the circuitry is configured to reduce an amount of water introduced into the blasthole from the water injection system responsive to determining the existence of groundwater in the blasthole.

4. The rock drill cutting system according to claim 2, wherein the circuitry is configured to reduce an amount of water introduced into the blasthole from the water injection system responsive to determination of each of a first depth and a second depth having groundwater, the first and second depths being separated by a third depth determined not to have groundwater.

5. The rock drill cutting system according to claim 1, wherein the predetermined depth intervals are in increments of at or about 1 mm to at or about 2 mm.

6. The rock drill cutting system according to claim 1, wherein the circuitry is configured to control a dust management system of the drilling machine responsive to determining the existence of groundwater in the blasthole.

7. The rock drill cutting system according to claim 1, wherein the circuitry is configured to electrically offload the map in a batch file to a back office system when the map of the blasthole is completed.

8. The rock drill cutting system according to claim 1, wherein the map identifies an amount of water volume being added to the blasthole by the determined groundwater.

9. A method of determining groundwater location at a worksite via a set of one or more drill holes at the worksite, the method comprising:

receiving, in real time, using an electronic processor, signaling from a moisture sensor regarding moisture content of cuttings at a collar of one of the one or more drill holes as the cuttings exit the drill hole as a drilling machine drills the drill hole;

determining, in real time, using the electronic processor, whether groundwater exists in the drill hole based on the signaling from the moisture sensor regarding moisture content of the cuttings, as the drilling machine drills the drill hole; and logging, in real time, using the electronic processor, depth in the drill hole at which each groundwater determination occurs, as the drilling machine drills the drill hole, wherein said determining whether groundwater exists includes determining when a water content value of the cuttings has increased by a predetermined amount relative to an immediately previous water content value of the cuttings.

10. The method of claim 9, further comprising determining, using the electronic processor, an amount of water volume associated with each identified existence of groundwater, wherein said logging associates the amount of water volume with the depth in the drill hole at which the groundwater determination occurs.

11. The method of claim 9, further comprising:

electronically offloading in a batch file, using the electronic processor, logging information created by said logging to a back office system when the drilling machine reaches a bottom of the drill hole;

performing said receiving, said determining, said logging, and said electronically offloading for at least one additional drill hole of the set of one or more drill holes; and mapping, using a back office system, groundwater locations at the worksite using logs of the depths in the drill holes at which each groundwater determination occurred.

12. The method of claim 9, wherein said logging includes logging one or more intersections of dry rock and wet rock associated with each groundwater existence determination.

13. The method of claim 9, further comprising displaying, in real time, using the electronic processor, on an operator control interface of the drilling machine, groundwater determination information responsive to determination of groundwater existence in the drill hole.

14. The method of claim 9, wherein the immediately previous water content value is a non-zero value due to water introduced into the drill hole from a water injection system of the drilling machine.

15. A non-transitory computer-readable storage medium having stored thereon instructions that, when executed by one or more processors, cause the one or more processors to perform a method comprising:

continuously determining presence or not of groundwater in a blasthole based on signals from one or more moisture sensors regarding moisture content of rock cuttings as a drilling machine drills the blasthole; and continuously mapping the blasthole for groundwater based on said continuously determining presence or not of groundwater as the drilling machine drills the blasthole, the mapping including location in the blasthole where the presence of groundwater is identified, wherein said continuously determining presence or not of groundwater includes determining when a water content value of the rock cuttings increases by a predetermined amount.

16. The non-transitory computer-readable storage medium according to claim 15, wherein the method further comprises determining an amount of water volume associated with each determined presence of groundwater, wherein said continuously mapping associates the amount of water volume with the location in the drill hole at which the presence of groundwater is identified.

17. The non-transitory computer-readable storage medium according to claim 15, wherein the method further comprises reducing an amount of water introduced into the blasthole from a water injection system when said continuously determining determines the presence of groundwater in the blasthole.

18. The non-transitory computer-readable storage medium according to claim 15, further comprising turning off a dust management system of the drilling machine each time said continuously determining determines the presence of groundwater in the blasthole.

19. The non-transitory computer-readable storage medium according to claim 15, wherein the method further comprises electronically offloading mapping information in a batch file to a back office system when the drilling machine reaches a bottom of the blasthole.

20. The non-transitory computer-readable storage medium according to claim 15, wherein said continuously determining presence or not of groundwater in the blasthole identifies each transition from no presence of groundwater to presence of groundwater and from presence of groundwater to no presence of groundwater when drilling the blasthole.

* * * * *